US006302556B1

(12) United States Patent
Filip

(10) Patent No.: US 6,302,556 B1
(45) Date of Patent: Oct. 16, 2001

(54) DECORATIVE CEILING FAN ASSEMBLY

(76) Inventor: Timothy K. Filip, 712 Plank Rd., New Lenox, IL (US) 60451

( * ) Notice: Subject to any disclaimer, the term of this patent is extended or adjusted under 35 U.S.C. 154(b) by 0 days.

(21) Appl. No.: 09/663,122

(22) Filed: Sep. 15, 2000

(51) Int. Cl.[7] ..... F21V 33/00

(52) U.S. Cl. ..... 362/96; 362/404; 362/806; 416/5

(58) Field of Search ..... 362/96, 404, 249, 362/294, 806, 253; 416/5

(56) References Cited

U.S. PATENT DOCUMENTS

| | | | | |
|---|---|---|---|---|
| D. 364,223 | | 11/1995 | Dipasquale . | |
| 4,342,073 | * | 7/1982 | Ranten | 362/294 |
| 4,382,400 | * | 5/1983 | Stutzman | 362/294 |
| 5,195,870 | | 3/1993 | Liu . | |
| 5,311,226 | | 5/1994 | Karasawa . | |
| 5,414,480 | | 5/1995 | Morizumi . | |
| 5,517,264 | | 5/1996 | Sutton . | |
| 5,658,129 | | 8/1997 | Pearce . | |
| 6,193,384 | * | 2/2001 | Stein | 362/96 |

* cited by examiner

*Primary Examiner*—Thomas M. Sember

(57) ABSTRACT

A decorative ceiling fan assembly for providing decorative lighting effects on walls and ceilings. The decorative ceiling fan assembly includes a housing couplable to a ceiling of a structure, a motor assembly positioned substantially within the housing, a plurality of fan blades each having a first end coupled to the motor, and a plurality of lamps each positioned substantially within the housing.

10 Claims, 5 Drawing Sheets

DECORATIVE CEILING FAN ASSEMBLY

BACKGROUND OF THE INVENTION

1. Field of the Invention

The present invention relates to ceiling fans and more particularly pertains to a new decorative ceiling fan assembly for providing decorative lighting effects on walls and ceilings.

2. Description of the Prior Art

The use of ceiling fans is known in the prior art. More specifically, ceiling fans heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,195,870; U.S. Pat. No. 5,517,264; U.S. Pat. No. 5,414,480; U.S. Pat. No. 5,311,226; U.S. Pat. No. 5,658,12*; and U.S. Pat. No. Des. 364,223.

While these devices fulfill their respective, particular objectives and requirements, the aforementioned patents do not disclose a new decorative ceiling fan assembly. The inventive device includes a housing couplable to a ceiling of a structure, a motor assembly positioned substantially within the housing, a plurality of fan blades each having a first end coupled to the motor, and a plurality of lamps each positioned substantially within the housing.

In these respects, the decorative ceiling fan assembly according to the present invention substantially departs from the conventional concepts and designs of the prior art, and in so doing provides an apparatus primarily developed for the purpose of providing decorative lighting effects on walls and ceilings.

SUMMARY OF THE INVENTION

In view of the foregoing disadvantages inherent in the known types of ceiling fans now present in the prior art, the present invention provides a new decorative ceiling fan assembly construction wherein the same can be utilized for providing decorative lighting effects on walls and ceilings.

The general purpose of the present invention, which will be described subsequently in greater detail, is to provide a new decorative ceiling fan assembly apparatus and method which has many of the advantages of the ceiling fans mentioned heretofore and many novel features that result in a new decorative ceiling fan assembly which is not anticipated, rendered obvious, suggested, or even implied by any of the prior art ceiling fans, either alone or in any combination thereof.

To attain this, the present invention generally comprises a housing couplable to a ceiling of a structure, a motor assembly positioned substantially within the housing, a plurality of fan blades each having a first end coupled to the motor, and a plurality of lamps each positioned substantially within the housing.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new decorative ceiling fan assembly apparatus and method which has many of the advantages of the ceiling fans mentioned heretofore and many novel features that result in a new decorative ceiling fan assembly which is not anticipated, rendered obvious, suggested, or even implied by any of the prior art ceiling fans, either alone or in any combination thereof.

It is another object of the present invention to provide a new decorative ceiling fan assembly which may be easily and efficiently manufactured and marketed.

It is a further object of the present invention to provide a new decorative ceiling fan assembly which is of a durable and reliable construction.

An even further object of the present invention is to provide a new decorative ceiling fan assembly which is susceptible of a low cost of manufacture with regard to both materials and labor, and which accordingly is then susceptible of low prices of sale to the consuming public, thereby making such decorative ceiling fan assembly economically available to the buying public.

Still yet another object of the present invention is to provide a new decorative ceiling fan assembly which provides in the apparatuses and methods of the prior art some of the advantages thereof, while simultaneously overcoming some of the disadvantages normally associated therewith.

Still another object of the present invention is to provide a new decorative ceiling fan assembly for providing decorative lighting effects on walls and ceilings.

Yet another object of the present invention is to provide a new decorative ceiling fan assembly which includes a housing couplable to a ceiling of a structure, a motor assembly positioned substantially within the housing, a plurality of fan blades each having a first end coupled to the motor, and a plurality of lamps each positioned substantially within the housing.

Still yet another object of the present invention is to provide a new decorative ceiling fan assembly that allows lighting effects to be easily changed for seasonal or celebratory moods.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
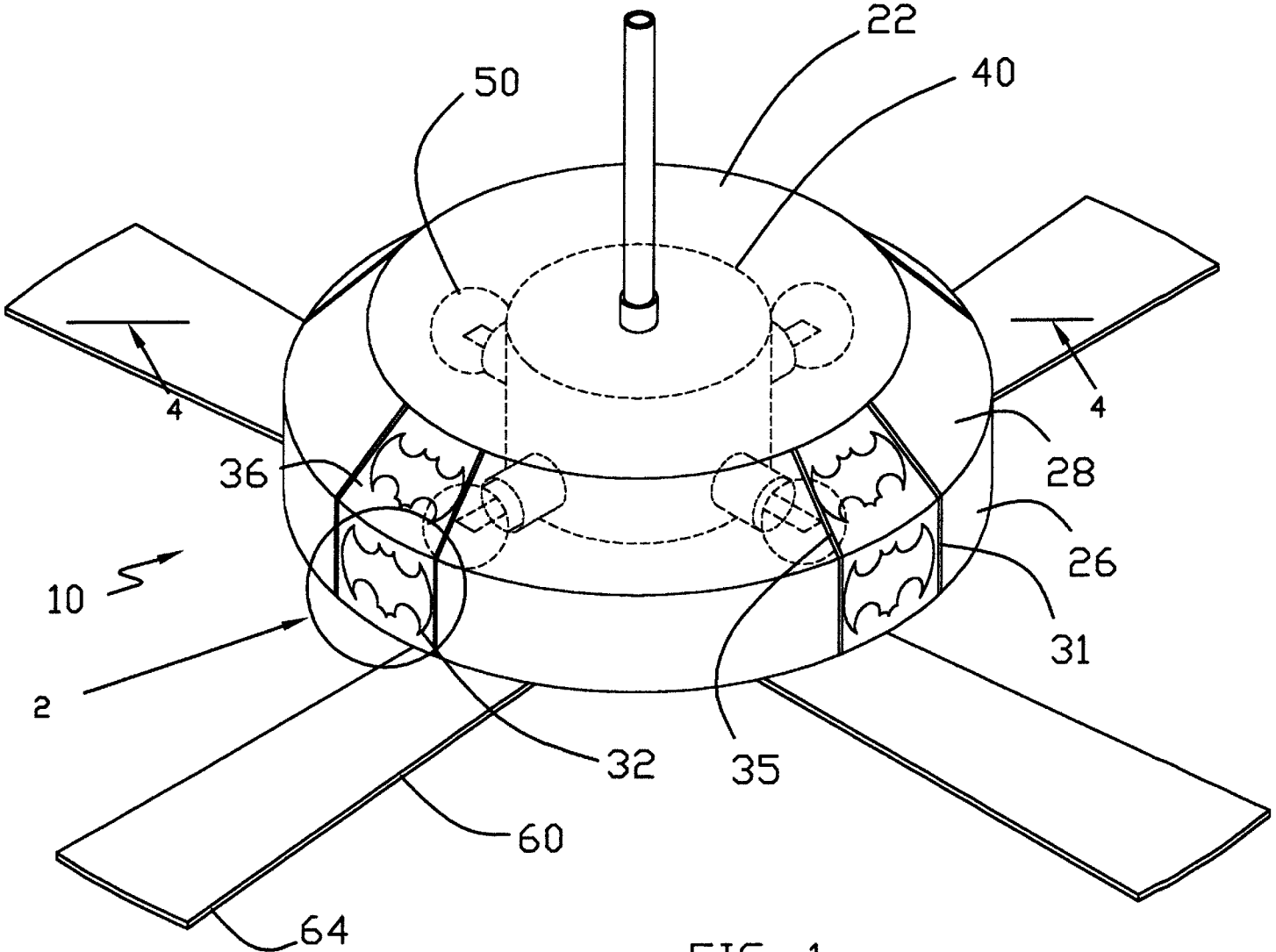
FIG. 1 is a schematic perspective view of a new decorative ceiling fan assembly according to the present invention.
Figure 3:
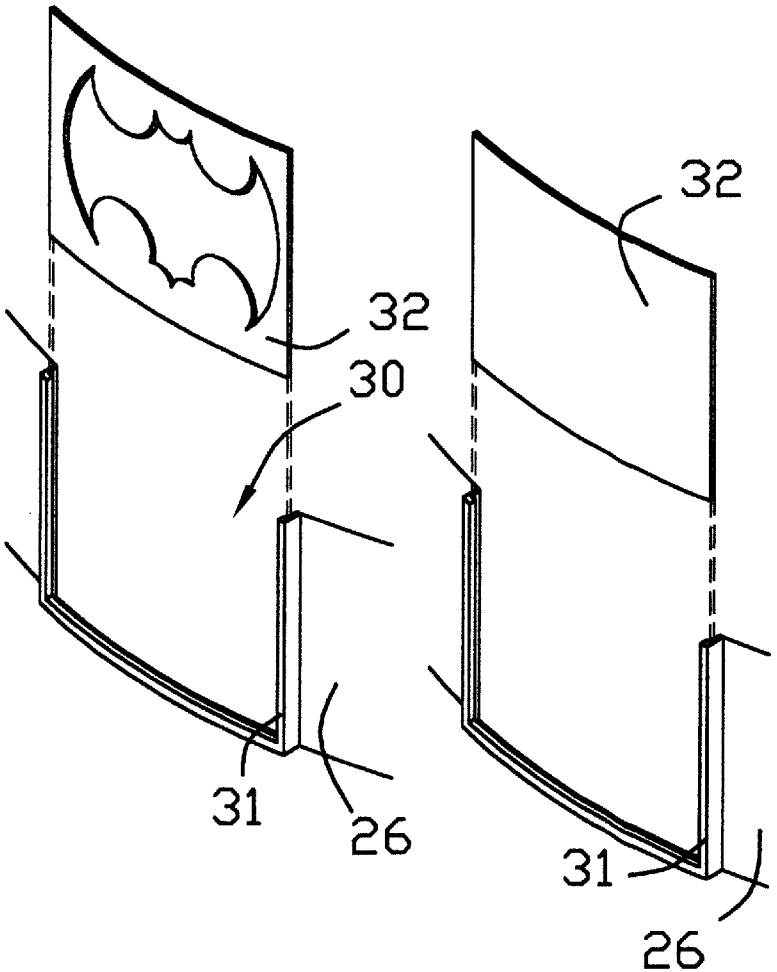
FIG. 3 is a schematic perspective view of the stencil holder and stencils of the present invention.
Figure 2:
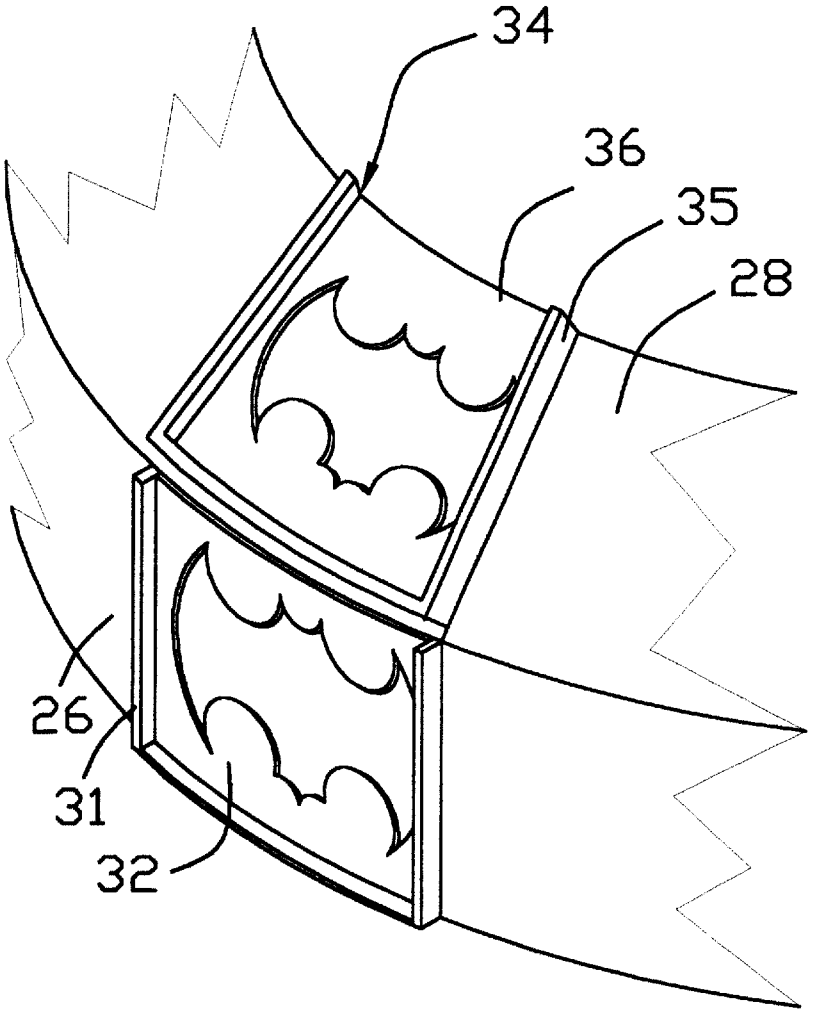
FIG. 2 is a schematic detail view of the present invention taken along area 2 of FIG. 1.
Figure 4:
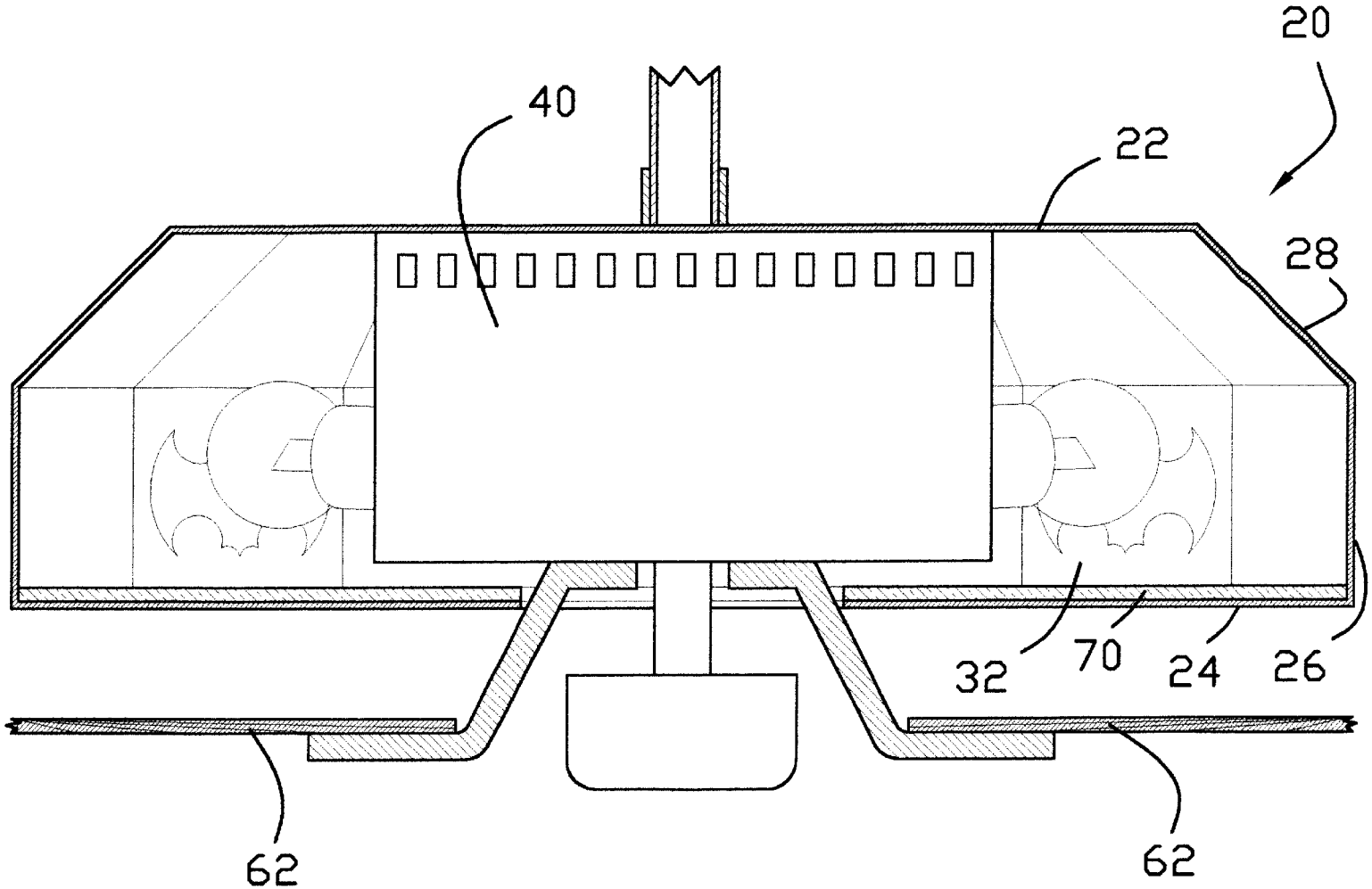
FIG. 4 is a schematic cross-sectional view of the present invention.
Figure 5:
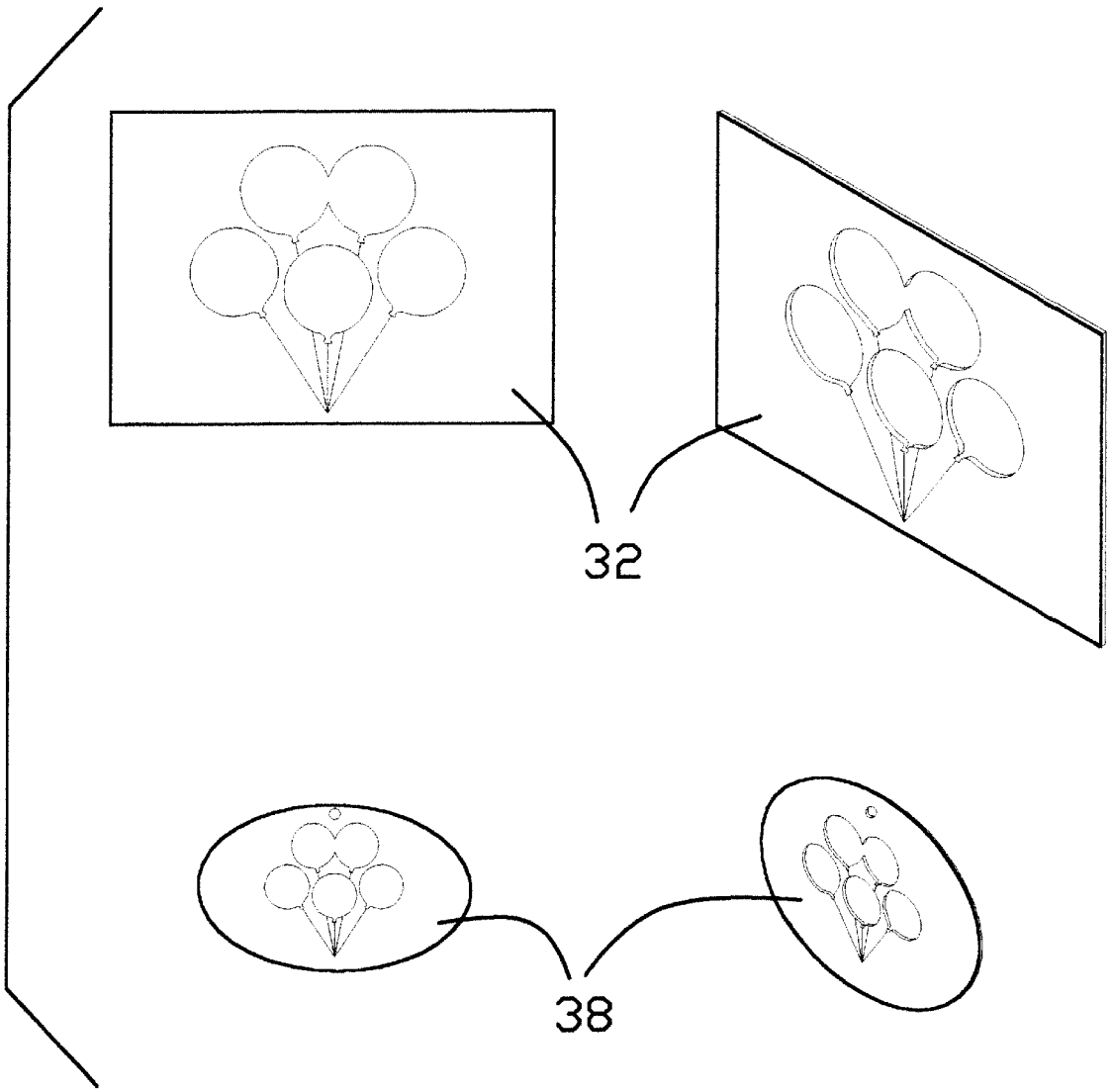
FIG. 5 is a schematic detail view of an embodiment of stencil and pull chain member of the present invention.
Figure 6:
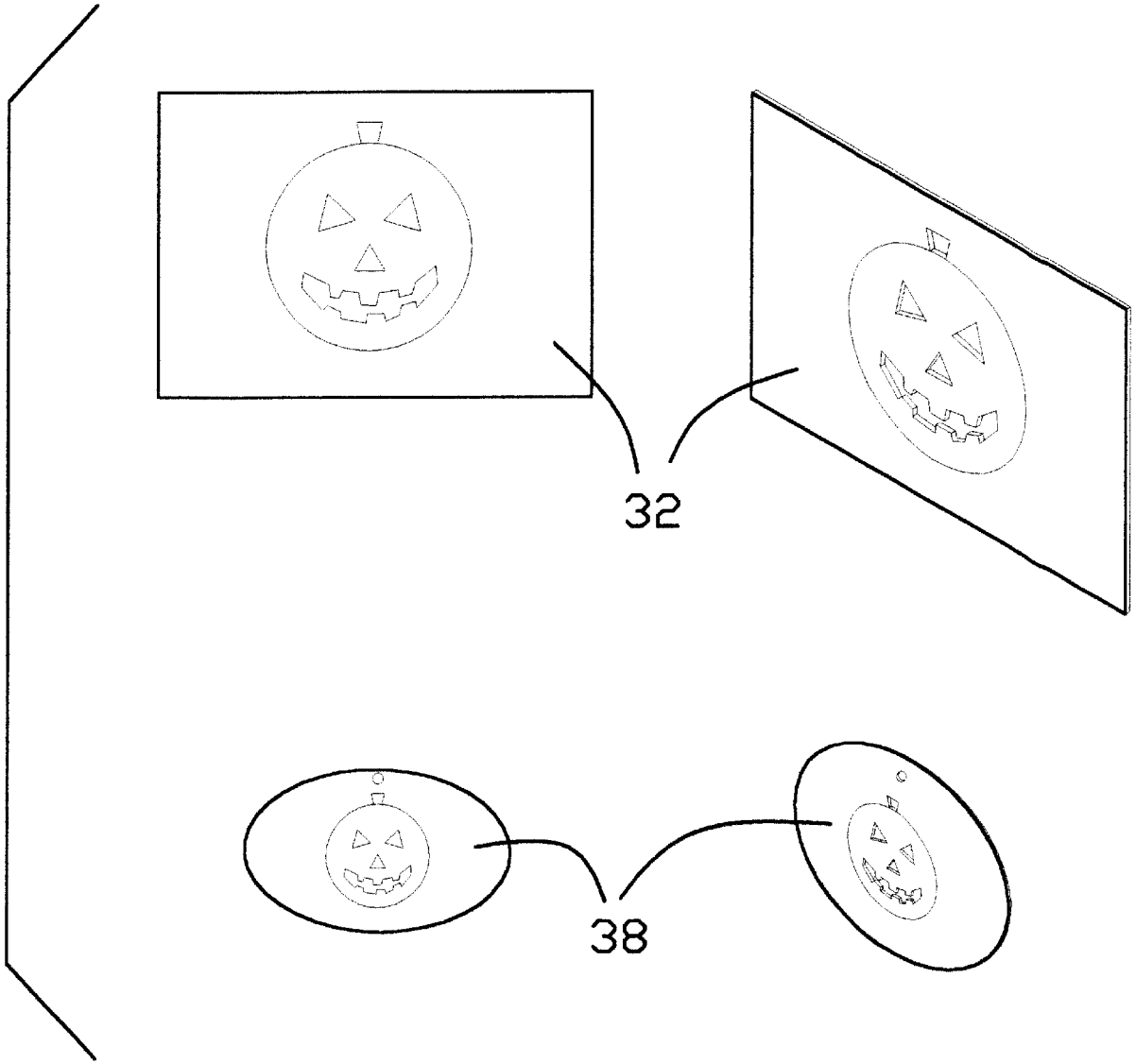
FIG. 6 is a schematic detail view of a further embodiment of stencil and pull chain member of the present invention.

With reference now to the drawings, and in particular to FIGS. 1 through 6 thereof, a new decorative ceiling fan assembly embodying the principles and concepts of the present invention and generally designated by the reference numeral 10 will be described.

As best illustrated in FIGS. 1 through 6, the decorative ceiling fan assembly 10 generally comprises an housing 20, a motor assembly 40, a plurality of lamps 50, and a plurality of fan blades 60.

The housing 20 is couplable to a ceiling of a structure. The housing 20 is substantially cylindrical. The housing 20 includes a top wall 22 and a bottom wall 24. The housing includes a perimeter wall 26, which extends between the top wall 22 and the bottom wall 24.

The motor assembly 40 is positioned substantially within the housing 20.

Each one of the plurality of fan blades 60 includes a first end 62 and a second end 64. Each first end 62 is coupled to the motor assembly 40. Each one of the fan blades 60 is positioned such that each one of the fan blades 60 extends radially outward from a longitudinal axis of the housing 20. The motor assembly 40 rotates each one of the fan blades 60 with respect to the housing 20.

Each one of the plurality of lamps 50 is positioned substantially within the housing 20.

A plurality of openings 30 is positioned in a substantially spaced orientation around the perimeter wall 26 of the housing 20.

Each one of a plurality of stencil holders 31 is positioned around an edge of an associated one of the openings 30.

Each one of a plurality of stencils 32 is positionable in an associated one of the stencil holders 31. The plurality of stencils 32 is for directing a shaped pattern of light from the plurality of lamps 50, onto a wall of a structure.

The top wall 22 has a diameter substantially smaller than a diameter of the bottom wall 24. The perimeter wall 26 extends substantially upward from the bottom wall 24. The perimeter wall 26 is oriented substantially perpendicular to the bottom wall 24. The second perimeter wall 28 extends between a top edge of the perimeter wall 26 and the top wall 22.

Each one of a plurality of second openings 34 is positioned in a substantially spaced orientation around the second perimeter wall 28 of the housing 20.

Each one of a plurality of second stencil holders 35 is positioned around an edge of an associated one of the second openings 34.

Each one of a plurality of second stencils 36 is positionable in an associated one of the second stencil holders 35. The plurality of second stencils 36 is for directing a shaped pattern of light from the plurality of lamps 50 onto a wall of a structure.

The decorative ceiling fan assembly 10 includes at least one pull-chain type switch. A decorative pull member 38 is positioned at a distal end of a chain associated with the pull-chain type switch. The decorative pull member 38 includes a shape matching a shape of each one of the stencils 32.

In one embodiment each one of the plurality of stencils 32, each one of the plurality of second stencils 36, and the decorative pull member 38 has the shape of a bat.

In a further embodiment each one of the plurality of stencils 32, each one of the plurality of second stencils 36, and the decorative pull member 38 has the shape of a jack-o-lantern.

In an embodiment each one of the plurality of stencils 32, each one of the plurality of second stencils 36, and the decorative pull member 38 has the shape of a plurality of balloons.

In another embodiment each one of the plurality of stencils 32 and each one of the plurality of second stencils 36 is substantially translucent and not includes a decorative shape.

A plurality of mirrors 70 is positionable within the housing 20. Each one of the plurality of mirrors 70 is for directing light produced from an associated one of the lamp 50 through an associated pairing of a stencil 32 and a second stencil 36.

In an embodiment the housing 20 is rotatably coupled to the ceiling of the structure. The housing 20 is coupled to the motor assembly 40 such that the motor assembly 40 rotates the housing 20 with respect to the ceiling. Thus the shaped pattern of light produced by each pairing of one of the plurality of lamps 50 and one of the plurality of stencils 32 is movable along the walls of the structure; and the shaped pattern of light produced by each pairing of one of the plurality of lamps 50 and one of the plurality of second stencils 36 is movable along the ceiling of the structure.

In use, the decorative ceiling fan assembly is installed on a ceiling of a structure. The user selects the desired stencils and second stencils to be placed in the stencil holders and second stencil holders. The user then selects a decorative pull member to be coupled to the chain of the chain-pull type switch. The decorative ceiling fan assembly is then ready to project decorative lighting patterns on the walls and ceiling of the structure.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A decorative ceiling fan assembly compromising:

a housing couplable to a ceiling of a structure, said housing being substantially cylindrical, said housing having a top wall and a bottom wall extending between said top and said bottom wall;

a motor assembly positioned substantially within said housing;

a plurality of fan blades, each one of said fan blades having a first end and a second end, each first end being coupled to said motor assembly, each one of said fan blades being positioned such that each one of said fan blades extends radially outward from an longitudinal axis of said housing, said motor assembly rotating each one of said lamps being positioned substantially within said housing; and wherein said housing further comprises:

a plurality of openings positioned in a substantially spaced orientation around said perimeter wall of said housing; a plurality of stencil holders each positioned around an edge of an associated one of said openings;

a plurality of stencils each one of said plurality of stencils being positionable in an associated one of said stencil holders, said plurality of stencils being for directing a shaped pattern of light from said plurality of lamps onto a wall of a structure.

2. The decorative ceiling fan assembly of claim 1, wherein said housing further comprises:

a second perimeter wall;

said top wall having a diameter substantially smaller than a diameter of said bottom wall, said perimeter wall extending substantially upward from said bottom wall, said perimeter wall being oriented substantially perpendicular to said bottom wall, said second perimeter wall extending between a top edge of said perimeter wall and said top wall.

3. A decorative ceiling fan assembly compromising:

a housing couplable to a ceiling of a structure, said housing being substantially cylindrical, said housing having a top wall and a bottom wall extending between said top and said bottom wall; a motor assembly positioned substantially within said housing;

a plurality of fan blades, each one of said fan blades having a first end and a second end, each first end being coupled to said motor assembly, each one of said fan blades being positioned such that each one of said fan blades extends radially outward from an longitudinal axis of said housing, said motor assembly rotating each one of said lamps being positioned substantially within said housing;

wherein said housing further compromises:

a second perimeter wall, and said top wall having a diameter substantially smaller than a diameter of said bottom wall, said perimeter wall extending substantially upward form said bottom wall, said perimeter wall being oriented substantially perpendicular to sad bottom wall, said perimeter wall and said top wall;

a plurality of second openings positioned in a substantially spaced orientation around said second perimeter wall of said housing;

a plurality of second stencil holders each positioned around an edge of an associated one of said second openings;

a plurality of second stencils, each one of said plurality of second stencils being positionable in an associated one of said second stencil holders, said plurality of second stencils being for directing a shaped pattern of light from said plurality of lamps onto a wall structure.

4. A decorative ceiling fan assembly compromising:

a housing couplable to a ceiling of a structure, said housing being substantially cylindrical, said housing having a top wall and a bottom wall, said housing having a perimeter wall extending between said top wall and said bottom wall;

a motor assembly positioned substantially within said housing;

a plurality of fan blades, each one of said fan blades having a first end and a second end, each first end being coupled to said motor assembly, each one of said fan blades being positioned such that each one of said fan blades extends radially outward from an longitudinal axis of said housing, said motor assembly rotating each one of said fan blades with respect to said housing;

a plurality of lamps, each one of said lamps being positioned substantially within said housing;

a plurality of opening positioned in a substantially spaced orientation around said perimeter wall of said housing;

a plurality of stencil holders each positioned around an edge of an associated one of said openings;

a plurality of stencils, each one of said plurality of stencils being positionable in an associated one of said stencil holders, said plurality of stencils being for directing a shaped pattern of light from said plurality of lamps onto a wall of a structure;

a second perimeter wall;

said top wall having a diameter substantially smaller than a diameter of said bottom wall, said perimeter wall extending substantially upward form said bottom wall, said perimeter wall being oriented substantially perpendicular to said bottom wall, said second perimeter wall extending between a tip edge of said perimeter wall and said top wall;

a plurality of second openings positioned in a substantially spaced orientation around said second perimeter wall of said housing;

a plurality of second stencil holders each positioned around an edge of an associated one of said second openings;

a plurality of second stencils, each one of said plurality of second stencils being positionable in an associated one of said second stencil holders, said plurality of second stencils being for directing a shaped pattern of light from said plurality of lamps onto a wall of a structure.

5. The decorative ceiling fan assembly of claim 4, further comprising:

wherein each one of said plurality of stencils, each one of said plurality of second stencils, and said decorative pull member substantially having the shape of a bat.

6. The decorative ceiling fan assembly of claim 4, further comprising:

wherein each one of said plurality of stencils, each one of said plurality of second stencils, and said decorative pull member substantially having the shape of a jack-o-lantern.

7. The decorative ceiling fan assembly of claim 4, further comprising:

wherein each one of said plurality of stencils, each one of said plurality of second stencils, and said decorative pull member substantially having the shape of a plurality of balloons.

8. The decorative ceiling fan assembly of claim 4, further comprising:

wherein each one of said plurality of stencils and each one of said plurality of second stencils being substantially translucent and not having a decorative shape.

9. The decorative ceiling fan assembly of claim 4, further comprising:

a plurality if mirrors positionable within said housing, each one of said plurality of mirrors being for directing light produced from an associated one of said lamp through an associated pairing of a stencil and a second stencil.

10. The decorative ceiling fan assembly of claim 4, further comprising:

said housing being rotatably coupled to the ceiling of the structure, said housing being coupled to said motor assembly such that said motor assembly rotates said housing with respect to the ceiling whereby the shaped pattern of light produced by each pairing of one of said plurality of lamps and one of said plurality of stencils is movable along the walls of the structure, and the shaped pattern of light produced by each pairing of one of said plurality of lamps and one of said plurality of second stencils is movable along the ceiling of the structure.

* * * * *